US005690131A

United States Patent [19]

Voigt

[11] Patent Number: 5,690,131

[45] Date of Patent: Nov. 25, 1997

[54] UMBRELLA

[76] Inventor: Bernard Voigt, 15 High St., Hicksville, N.Y. 11801

[21] Appl. No.: 654,228

[22] Filed: May 28, 1996

[51] Int. Cl.[6] ..... A45B 13/00

[52] U.S. Cl. ..... 135/19.5; 135/25.1; 135/26; 135/28

[58] Field of Search ..... 135/19.5, 25.1, 135/20.3, 25.41, 25.4, 26, 31, 34.2, 37–38

[56] References Cited

U.S. PATENT DOCUMENTS

| | | | |
|---|---|---|---|
| 1,937,363 | 11/1933 | Seraphim | 135/25.41 |
| 2,183,833 | 12/1939 | Farhar | 135/20.3 |
| 3,709,238 | 1/1973 | Leopoldi et al. | 135/25.41 X |
| 4,084,600 | 4/1978 | dePolo | 135/19.5 X |
| 4,259,974 | 4/1981 | dePolo | 135/26 X |
| 4,821,756 | 4/1989 | England | 135/19.5 |
| 4,966,179 | 10/1990 | Baldwin et al. | 135/19.5 |
| 5,188,137 | 2/1993 | Simonelli | 135/28 X |
| 5,285,803 | 2/1994 | Baldwin et al. | 135/19.5 |

FOREIGN PATENT DOCUMENTS

| | | | |
|---|---|---|---|
| 2681224 | 3/1993 | France | 135/19.5 |

*Primary Examiner*—Lanna Mai
*Attorney, Agent, or Firm*—Michael I. Kroll

[57] ABSTRACT

An improved umbrella is provided which consists of a fabric canopy, a central shank assembly and a mechanism for deploying the fabric canopy from and retracting the fabric canopy into the top of the central shank assembly.

26 Claims, 5 Drawing Sheets

(DEPLOYMENT SEQUENCE)

9C

9E (AUTOMATIC GUST ALEVIATION)

UMBRELLA

BACKGROUND OF THE INVENTION

1. Field of the Invention

The instant invention relates generally to umbrellas and more specifically it relates to an improved umbrella.

2. Description of the Prior Art

Numerous umbrellas have been provided in prior art that are each a device for protection from the weather consisting of a collapsible canopy mounted on a central rod. While these units may be suitable for the particular purpose to which they address, they would not be as suitable for the purposes of the present invention as heretofore described.

SUMMARY OF THE INVENTION

A primary object of the present invention is to provide an improved umbrella that will overcome the shortcomings of the prior art devices.

Another object is to provide an improved umbrella in which a central rod assembly will contain a canopy deployment and retraction mechanism, whereby the canopy fabric will be retained within the central rod assembly when in a retracted position.

An additional object is to provide an improved umbrella in which the canopy deployment and retraction mechanism is incorporated within the central rod assembly of a hand held style umbrella.

A further object is to provide an improved umbrella that is simple and easy to use.

A still further object is to provide an improved umbrella that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 5:
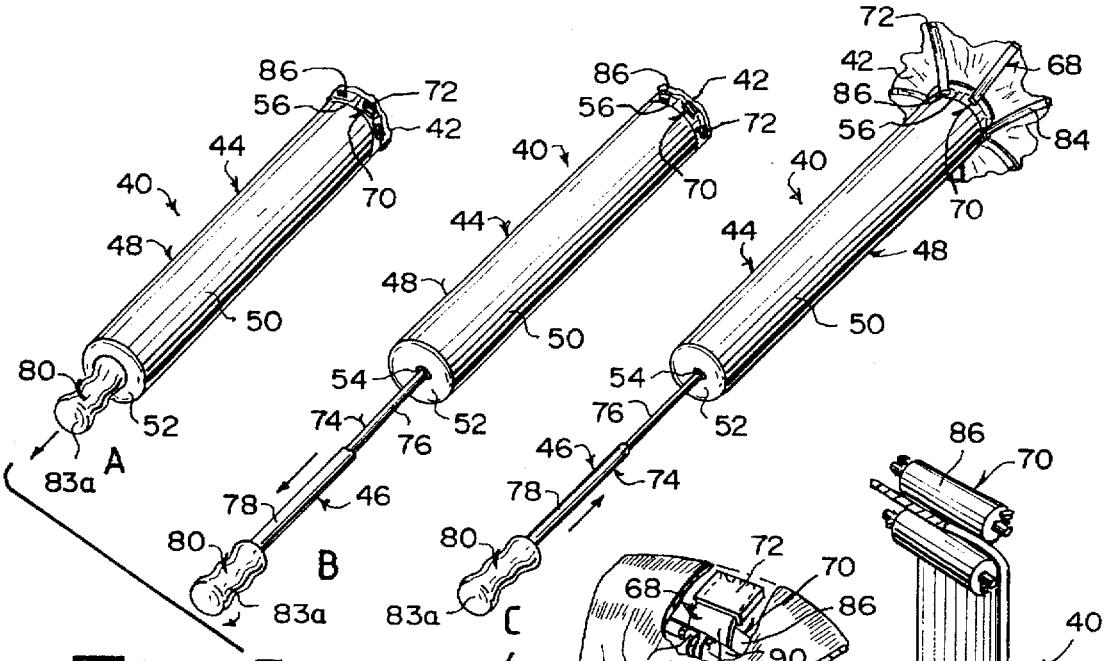

FIGS. 5A, B and C are perspective views showing the various sequences taken in operating the telescopic shaft for the deployment of the fabric canopy.

Figure 4:
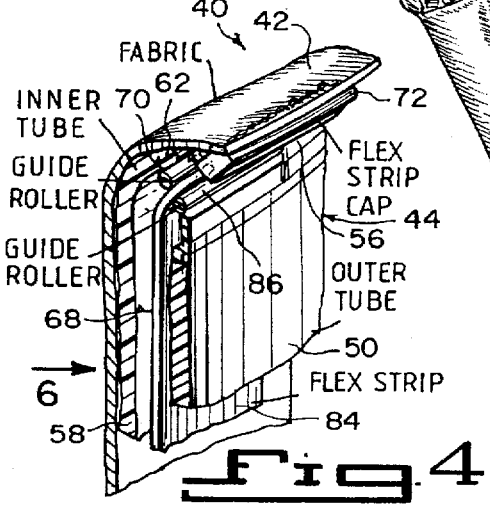
FIG. 4 is an enlarged perspective view with parts in section as indicated by arrow 4 in FIG. 3.
Figure 6:
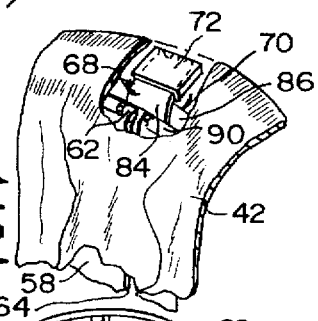

FIG. 6 is a perspective view taken in direction of arrow 6 in FIG. 4, with parts broken away.

Figure 3:
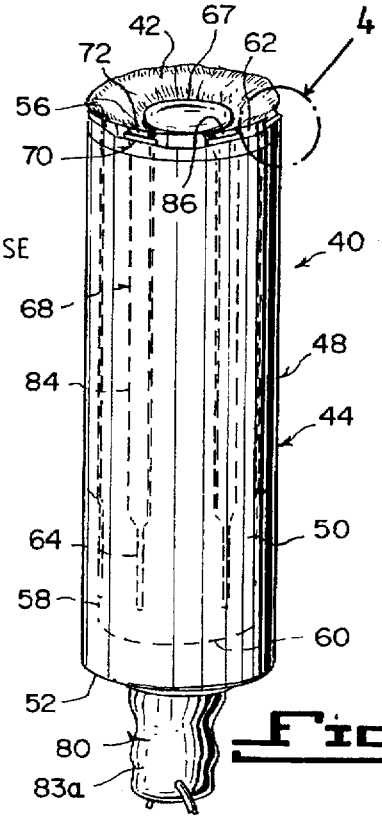
FIG. 3 is a perspective view of the instant invention with the fabric canopy retracted.
Figure 7B:
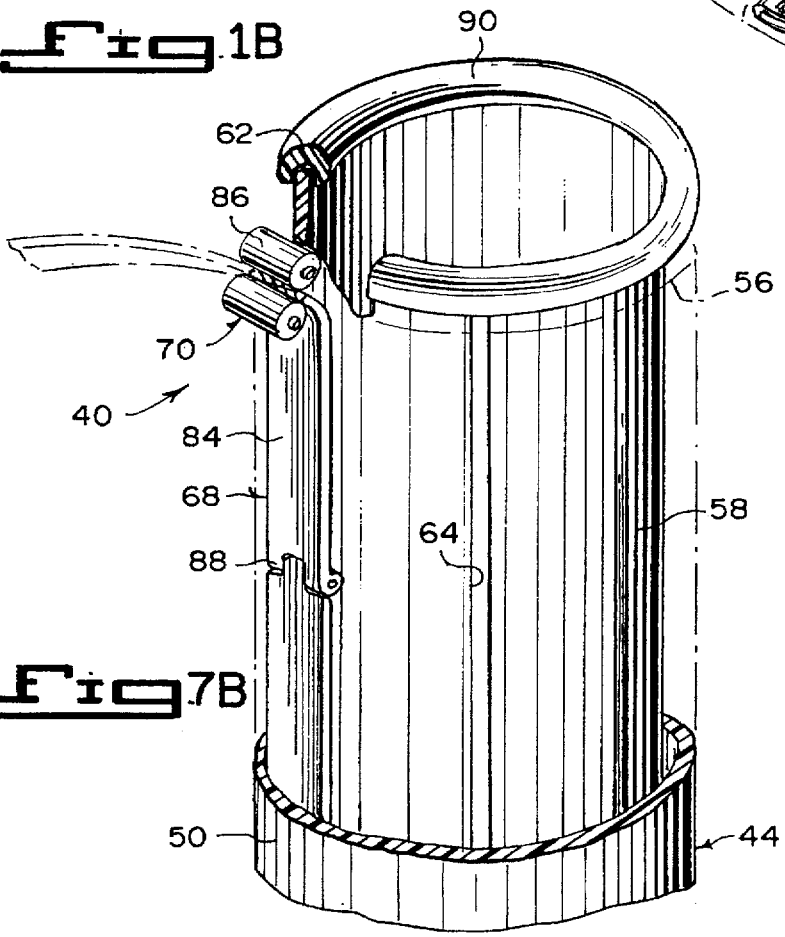
Figure 7:
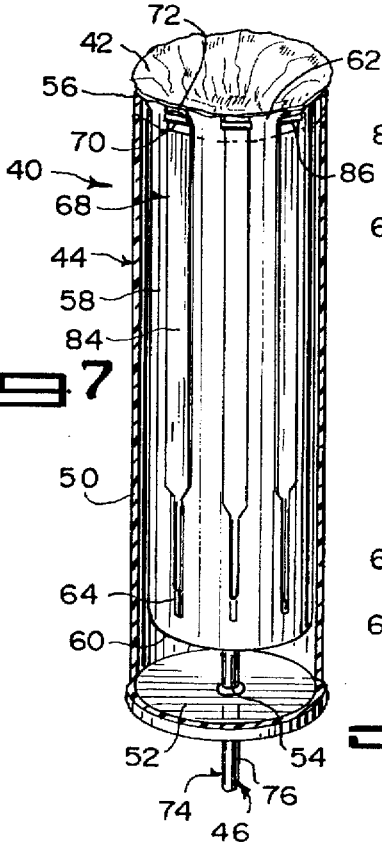

FIG. 7 is a perspective view similar to FIG. 3 with the outer tube broken away and in section and the telescopic shaft broken away.

Figure 7A:
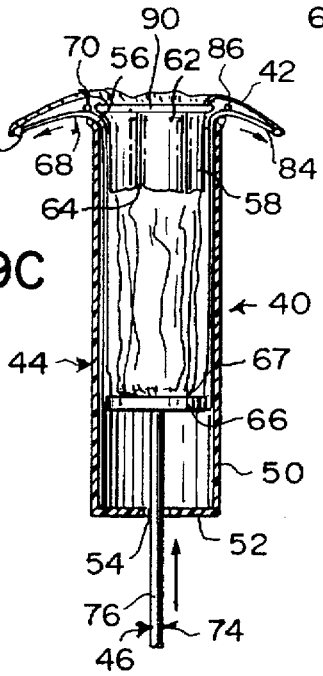

FIG. 7A is an elevational view similar to FIG. 7 with parts broken away and in section, showing the fabric canopy starting to be deployed therefrom.

FIG. 7B is a perspective view similar to the upper portion of FIG. 7 with the fabric canopy removed, showing one of the flex strips jointed in two parts by a hinge and a curved ring member attached to the top edge of the inner tube.

Figure 8:
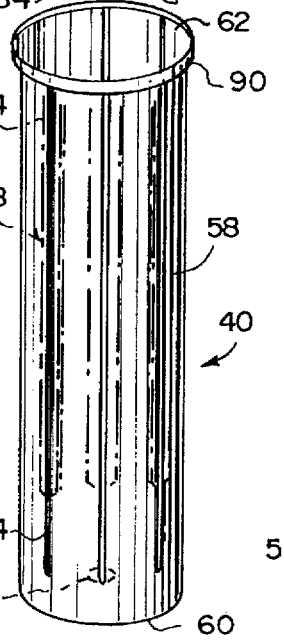

FIG. 8 is a perspective view of just the inner tube shown in FIG. 7.

Figure 9A:
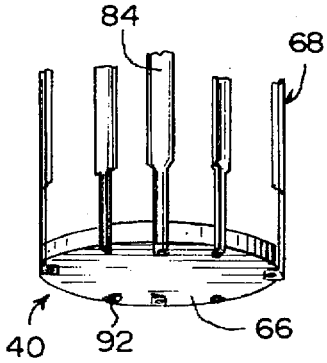
Figure 9:
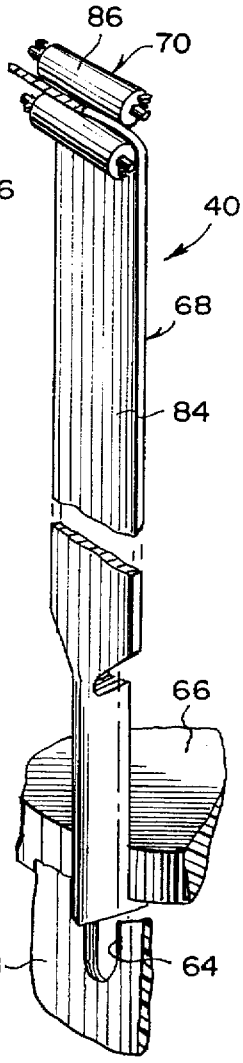

FIG. 9 is an enlarged perspective view with parts broken away of one of the flex strips and some of the cooperating structures shown in FIG. 7.

FIG. 9A is a bottom perspective view of the piston plate showing the lower ends of the flex strips connected thereto.

Figure 9B:
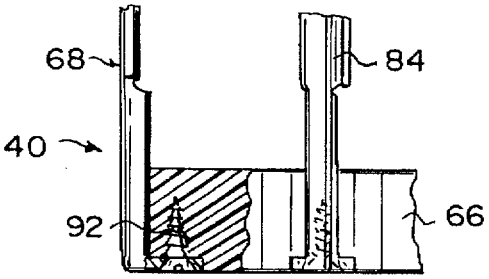

FIG. 9B is an enlarged partial side view with parts broken away and in section of the piston plate showing the lower ends of the flex strips connected thereto by screws.

Figure 9D:
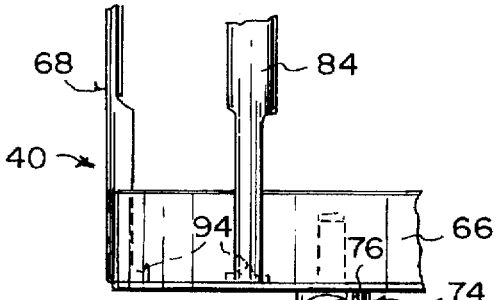
Figure 9C:
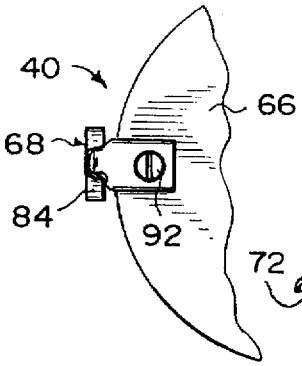

FIG. 9C is a partial bottom view taken in direction of arrow 9C in FIG. 9B.

FIG. 9D is an enlarged partial side view with parts broken away of the piston plate showing the lower ends of the flex strips connected thereto by prongs.

Figure 9E:
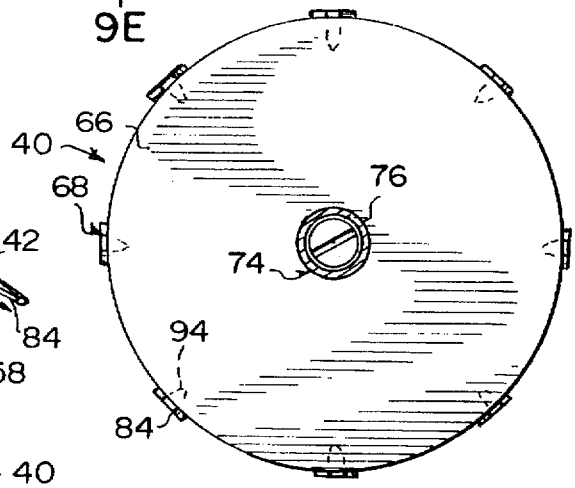

FIG. 9E is a complete bottom view taken in direction of arrow 9E in FIG. 9D.

Figure 10:
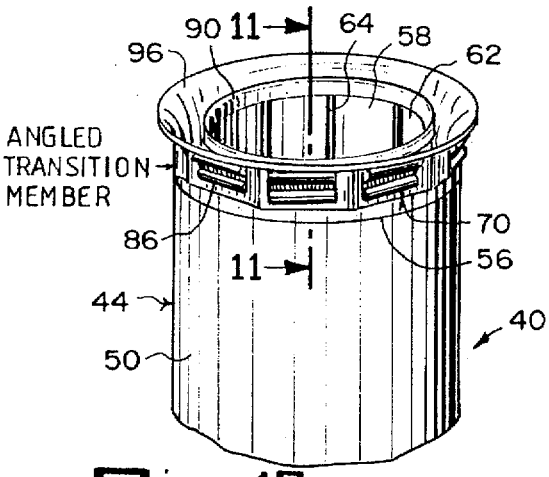

FIG. 10 is a perspective view similar to the upper portion of FIG. 3, with the fabric canopy and flex strips removed, showing an angled transition member on the top of the outer tube.

Figure 11:
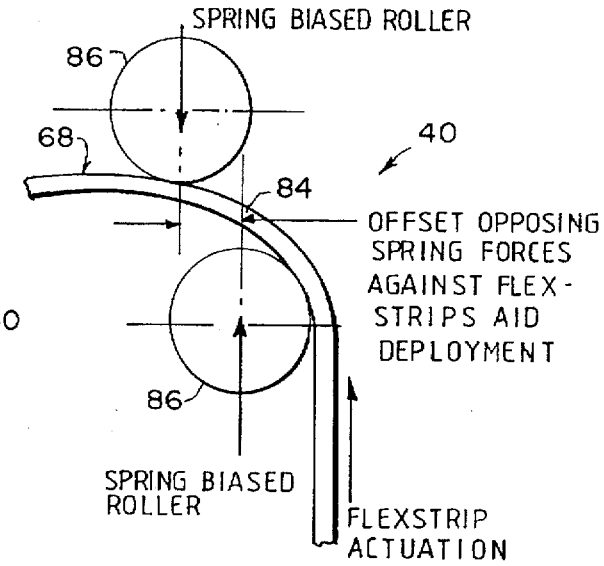

FIG. 11 is a diagrammatic cross sectional view taken along line 11—11 in FIG. 10, showing one of the flex strips being deployed between two of the offset spring biased guide rollers.

Figure 12:
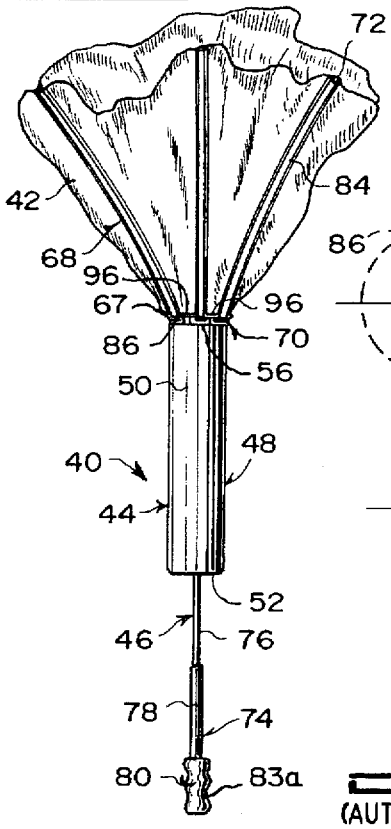

FIG. 12 is an elevational view showing the deployed fabric canopy being bent backwards by a wind gust.

Figure 13:
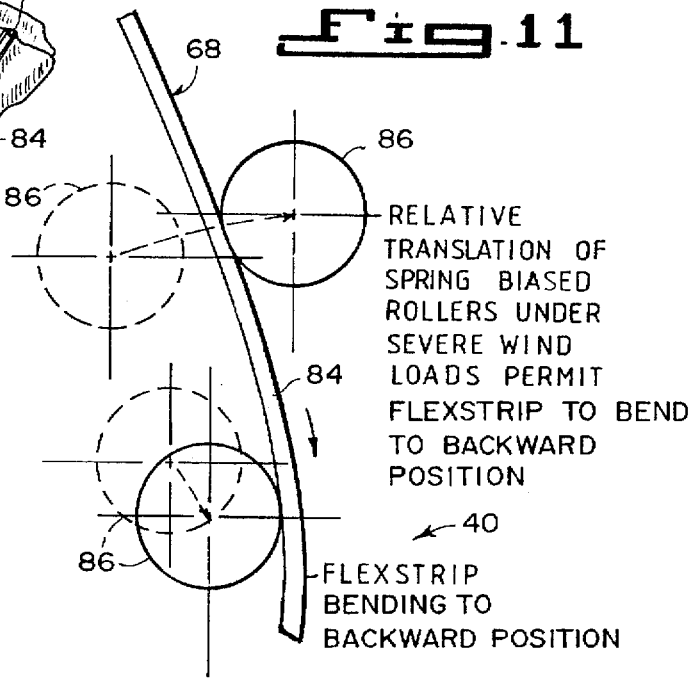

FIG. 13 is a diagrammatic cross sectional view similar to FIG. 11, showing the automatic gust alleviation condition of the spring biased guide rollers to allow the flex strip to be bent backwards.

Figure 14:
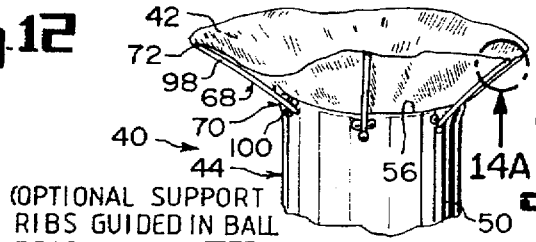

FIG. 14 is a perspective view similar to the upper portion of FIG. 3, with the fabric canopy partly deployed showing cylindrical flex rods guided in ball bearing units.

Figure 14A:
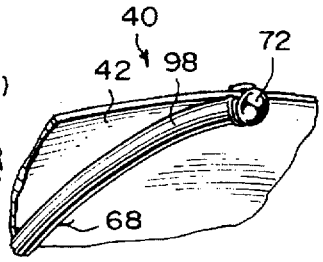

FIG. 14A is an enlarged perspective view as indicated by arrow 14A in FIG. 14.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, the FIGS. 1 through 14A illustrate an improved umbrella 40, which consists of a fabric canopy 42, a central shank assembly 44 and a mechanism 46 for deploying the fabric canopy 42 from and retracting the fabric canopy 42 into the top of the central shank assembly 44.

The improved umbrella 40, is a hand held style umbrella 48. The central shank assembly 44 includes an outer tube 50 having a closed bottom end 52 with a central aperture 54 therethrough and an open top end 56. An inner tube 58 has a closed bottom end 60 with a central aperture 61 therethrough, an open top end 62 and a plurality of longitudinal slots 64 radially spaced thereabout. The inner tube 58 is smaller in diameter than the outer tube 50.

The deploying and retracting mechanism 46 includes a piston plate 66 to ride within the inner tube 58, with the apex 67 of the fabric canopy 42 secured to the top of the piston plate 66. A plurality of support ribs 68 are affixed at their lower ends about the piston plate 66 in longitudinal radially spaced locations, so that each support rib 68 can extend through one of the longitudinal slots 64 in the inner tube 58. A plurality of guide assemblies 70 are rotatably secured between the open top ends 56, 62 of the outer tube 50 and the inner tube 58 in radially spaced locations, so that the support ribs 68 can ride through the guide assemblies 70. A plurality of tips 72 are for securing upper ends of the support ribs 68 to the outer edges of the fabric canopy 42.

A telescopic shaft 74 is provided in which a first segment 76 of the telescopic shaft 74 can slide through the central aperture 54 in the closed bottom end 52 of the outer tube 50, the central aperture 61 in the closed bottom end 60 of the inner tube 58 and be connected to the center of the bottom of the piston plate 68. After a second segment 78 of the telescopic shaft 74 is extended and locked, the first segment 76 of the telescopic shaft 74 can push the piston plate 66 towards the open top end 62 of the inner tube 58, causing the support ribs 68 to ride outwardly on the guide assemblies 70 to deploy the fabric canopy 42 therefrom. The first segment 76 of the telescopic shaft 74 can pull the piston plate 66 back towards the closed bottom end 60 of the inner tube 58, causing the support ribs 68 to ride inwardly on the guide assembles 70 to retract the fabric canopy 42 therein.

Figure 1:
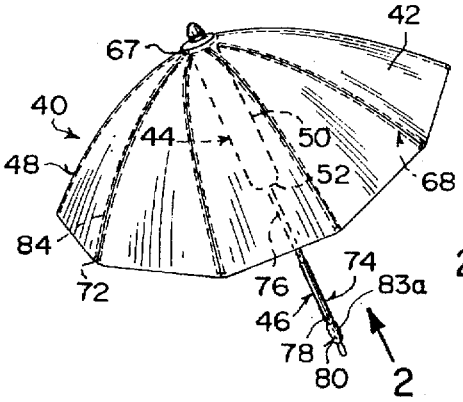
FIG. 1 is a top perspective view of the instant invention being a hand held style umbrella with the fabric canopy deployed.
Figure 2:
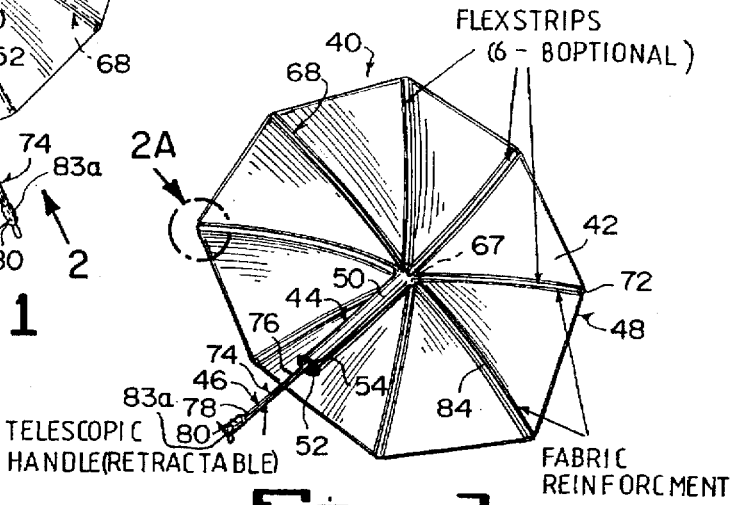
FIG. 2 is a bottom perspective view taken in direction of arrow 2 in FIG. 1.
Figure 1A:
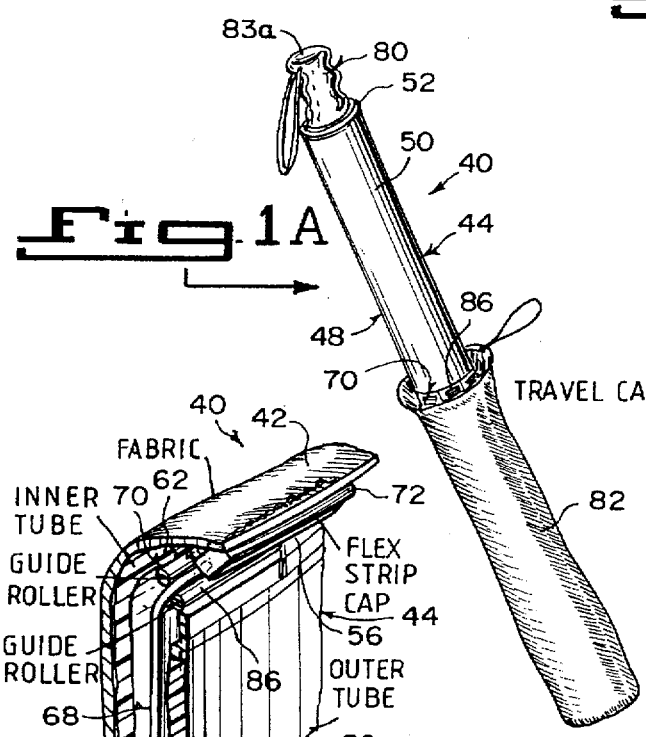
FIG. 1A is a perspective view of the instant invention being installed within a travel case after the fabric canopy has been retracted.
Figure 1B:
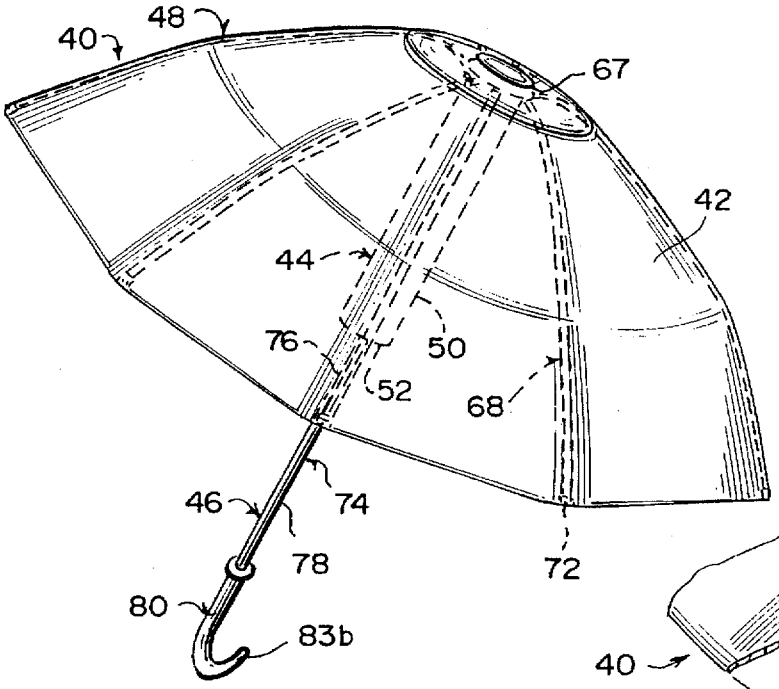
FIG. 1B is a top perspective view similar to FIG. 1, showing a different type of handle.
Figure 2A:
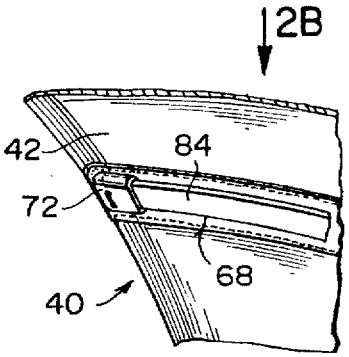
FIG. 2A is an enlarged bottom perspective view as indicated by arrow 2A in FIG. 2.
Figure 2B:
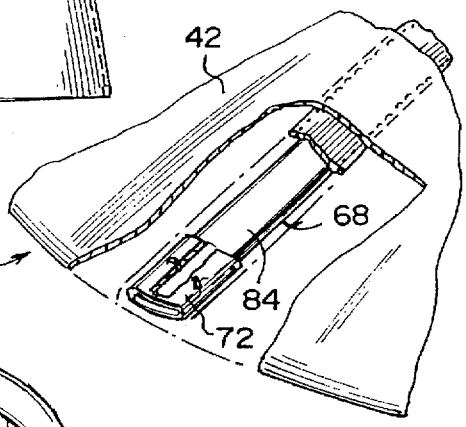
FIG. 2B is an enlarged perspective view as indicated by arrow 2B in FIG. 2A, with parts broken away.

A handle 80 is affixed to a distal free end of the deploying and retracting mechanism 46, so that a person can hold the handle 80 to carry the improved umbrella 40. As shown in FIG. 1A, a travel case 82 holds the hand held style umbrella 48 when collapsed and the fabric canopy 42 is retracted. The handle 80 can be a hand grip type 83*a* or a J-shaped type 83*b* (see FIG. 1B). Each support rib 68 is a flat flex strip 84 and each guide assembly 70 is a pair of guide rollers 86.

As shown in FIG. 7B, each flex strip 84 can be jointed in two parts by a hinge 88, while a curved ring member 90 can be attached to the open top end 62 of the inner tube 58. The lower end of each flex strip 84 can be affixed to the piston plate 66 by a screw 92, shown in FIGS. 9A, 9B and 9C. The lower end of each flex strip 84 can also be affixed to the piston plate 66 by a prong 94, as shown in FIGS. 9D and 9E.

As best seen in FIG. 10, an angled transition member 96 can also be affixed to the open top end 56 of the outer tube 50. Each set of guide rollers 86 are spring biased and carried offset in the angled transition member 96. If the fabric canopy 42 when deployed is bent backwards by a wind gust, as shown in FIG. 12, the guide rollers 86 can go into an automatic gust alleviation condition, as in FIG. 13, to easily allow the respective flex strip 84 to bend backwards. The fabric canopy 42 can then be retracted and deployed again. In FIGS. 14 and 14A, each support rib 68 is a cylindrical flex rod 98, while each guide assembly 70 is a ball bearing unit 100.

LIST OF REFERENCE NUMBERS

40 improved umbrella
42 fabric canopy of 40
44 central shank assembly of 40
46 deploying and retracting mechanism of 40
48 hand held style umbrella for 40
50 outer tube of 44
52 closed bottom end of 50
54 central aperture in 52
56 open top end of 50
58 inner tube of 44
60 closed bottom end of 58
61 central aperture in 60
62 open top end of 58
64 longitudinal slot in 58
66 piston plate of 46
67 apex of 42
68 support rib of 46
70 guide assembly of 46
72 tip for 68
74 telescopic shaft of 46
76 first segment of 74
78 second segment of 74
80 handle on 46
82 travel case for 40
83*a* hand grip type for 80
83*b* J-shaped type for 80
84 flat flex strip for 68
86 guide roller for 70
88 hinge on 84
90 curved ring member on 62
92 screw
94 prong
96 angled transition member on 56
98 cylindrical flex rod for 68

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved hand-held umbrella which comprises:

a) a fabric canopy;

b) a central shank assembly having:

i) an outer tube having a closed bottom end with a central aperture therethrough and an open top end; and ii) an inner tube having a closed bottom end with a central aperture therethrough, an open top end and a plurality of longitudinal slots radially spaced thereabout, said inner tube being smaller in diameter than said outer tube; and c) means for deploying said fabric canopy from and retracting said fabric canopy into the top of said central shank assembly.

2. An improved umbrella as recited in claim 1, wherein said deploying and retracting means includes:

a) a piston plate to ride within said inner tube, with the apex of said fabric canopy secured to the top of said piston plate;

b) a plurality of support ribs affixed at their lower ends about said piston plate in longitudinal radially spaced locations, so that each said support rib can extend through one of the longitudinal slots in said inner tube;

c) a plurality of guide assemblies, rotatably secured between the open top ends of said outer tube and said inner tube in radially spaced locations, so that said support ribs can ride through said guide assemblies;

d) a plurality of tips for securing upper ends of said support ribs to the outer edges of said fabric canopy; and e) a telescopic shaft in which a first segment of said telescopic shaft can slide through the central aperture in the closed bottom end of said outer tube, the central aperture in the closed bottom end of said inner tube and be connected to the center of the bottom of said piston plate, so that after a second segment of said telescopic shaft is extended and locked, the first segment of said telescopic shaft can push said piston plate towards the open top end of said inner tube, causing said support ribs to ride outwardly on said guide assemblies to deploy said fabric canopy therefrom, and the first segment of said telescopic shaft can pull said piston plate back towards the closed bottom end of the inner tube, causing said support ribs to ride inwardly on said guide assemblies to retract said fabric canopy therein.

3. An improved umbrella as recited in claim 2, wherein each said support rib is a flat flex strip.

4. An improved umbrella as recited in claim 3, further including:

a) each said flex strip is jointed in two parts by a hinge; and b) a curved ring member attached to the open top end of said inner tube.

5. An improved umbrella as recited in claim 3, wherein the lower end of each said flex strip is affixed to said piston plate by a screw.

6. An improved umbrella as recited in claim 3, wherein the lower end of each said flex strip is affixed to said piston plate by a prong.

7. An improved umbrella as recited in claim 2, wherein each said guide assembly is a pair of guide rollers.

8. An improved umbrella as recited in claim 7, further including:

a) an angled transition member affixed to the open top end of said outer tube; and b) each said set of guide rollers being spring biased and carried offset in said angled transition member, so that if said fabric canopy when deployed is bent backwards by a wind gust, said guide rollers can go into an automatic gust alleviation condition to easily allow said respective flex strip to bend backwards and said fabric canopy can then be retracted and deployed again.

9. An improved umbrella as recited in claim 2, wherein each said support rib is a cylindrical flex rod.

10. An improved umbrella as recited in claim 9, wherein each said guide assembly is a ball bearing unit.

11. An improved umbrella as recited in claim 2, further including a handle affixed to a distal free end of the said deploying and retracting means, so that a person can hold the handle to carry said improved umbrella.

12. An improved umbrella as recited in claim 11, further including a travel case to hold said hand held style umbrella when collapsed and said fabric canopy is retracted.

13. An improved umbrella as recited in claim 12, wherein said handle is a hand grip type.

14. An improved umbrella as recited in claim 12, wherein said handle is a J-shaped type.

15. An improved umbrella as recited in claim 12, wherein each said support rib is a flat flex strip.

16. An improved umbrella as recited in claim 15, wherein each said guide assembly is a pair of guide rollers.

17. An improved umbrella as recited in claim 16, further including:

a) each said flex strip is jointed in two parts by a hinge; and b) a curved ring member attached to the open top end of said inner tube.

18. An improved umbrella as recited in claim 16, wherein the lower end of each said flex strip is affixed to said piston plate by a screw.

19. An improved umbrella as recited in claim 16, wherein the lower end of each said flex strip is affixed to said piston plate by a prong.

20. An improved umbrella as recited in claim 16, further including:

a) an angled transition member affixed to the open top end of said outer tube; and b) each said set of guide rollers being spring biased and carried offset in said angled transition member, so that if said fabric canopy when deployed is bent backwards by a wind gust, said guide rollers can go into an automatic gust alleviation condition to easily allow said respective flex strip to bend backwards and said fabric canopy can then be retracted and deployed again.

21. An improved umbrella as recited in claim 12, wherein each said support rib is a cylindrical flex rod.

22. An improved umbrella as recited in claim 21, wherein each said guide assembly is a ball bearing unit.

23. An improved umbrella as recited in claim 1, further including a handle affixed to a distal free end of the said deploying and retracting means, so that a person can hold the handle to carry said improved umbrella.

24. An improved umbrella as recited in claim 23, wherein said handle is a hand grip type.

25. An improved umbrella as recited in claim 23, wherein said handle is a J-shaped type.

26. An improved umbrella as recited in claim 1, further including a travel case to hold said hand held style umbrella when collapsed and said fabric canopy is retracted.

* * * * *